United States Patent [19]

Bavelloni

[11] Patent Number: 4,608,783

[45] Date of Patent: Sep. 2, 1986

[54] FEELER UNIT FOR POSITIONING SHEET GLASS PROCESSING TOOLS

[75] Inventor: Franco Bavelloni, Appiano Gentile, Italy

[73] Assignee: Z. Bavelloni S.p.A., Bregnano, Italy

[21] Appl. No.: 562,616

[22] Filed: Dec. 19, 1983

[30] Foreign Application Priority Data

Dec. 23, 1982 [IT] Italy ..... 24969 A/82

[51] Int. Cl.[4] ..... B24B 9/08

[52] U.S. Cl. ..... 51/127; 51/100 R; 51/283 E; 51/238 R; 144/144 R; 144/372; 409/138

[58] Field of Search ..... 51/78, 92 R, 99, 100 R, 51/102, 110, 122, 127, 139, 283 R, 283 E, 238 R, 238 S; 144/144 R, 372; 409/138

[56] References Cited

U.S. PATENT DOCUMENTS

| | | | |
|---|---|---|---|
| 2,015,720 | 10/1935 | Louviaux | 51/100 R |
| 2,465,528 | 3/1949 | Goodwin | 51/102 X |
| 2,578,789 | 12/1951 | Donnelly | 51/110 |
| 3,187,467 | 6/1965 | Cortesi | 51/283 E X |
| 3,191,500 | 6/1965 | Schuster | 409/138 |
| 3,827,189 | 8/1974 | Highberg et al. | 51/283 E X |
| 3,922,951 | 12/1975 | Linsinger | 409/138 |
| 4,412,401 | 11/1983 | Fundell | 51/99 X |

*Primary Examiner*—Robert P. Olszewski

*Attorney, Agent, or Firm*—Guido Modiano; Albert Josif

[57] ABSTRACT

The invention is concerned with a feeler unit for positioning sheet glass processing tools, which comprises a frame carrying at least one feeler roller piloting a tool holder head positioning motor, and a back-up roller engageable with the underside of a sheet glass edge being processed and rotatable about an axis which extends substantially parallel to the plane containing the glass sheet and substantially perpendicular to the edge being processed.

A peculiar aspect of the invention is that a controlled movement of the back-up roller to and/or from the glass sheet, as well as controllable displacing of the back-up roller along a direction which is substantially parallel to a tangential direction to the glass sheet edge and perpendicular to the axis of the feeler roller are effected to vary the mutual position relationship between the feeler roller and back-up roller.

3 Claims, 2 Drawing Figures

10
10'
11
12
30
1
21
20
13
3
3''

A
4
2
3'
3
3''
10
10''
11
12
13
21
20
15
16
18
1

FEELER UNIT FOR POSITIONING SHEET GLASS PROCESSING TOOLS

BACKGROUND OF THE INVENTION

This invention relates to a feeler unit for positioning sheet glass processing tools.

As is known, sheet glass is laid, for processing of the sheet edges thereof, onto a supporting table which is driven to bring the edge of the sheet below a working head which will effect the edge processing.

Since the edge of the glass sheet is below the working head of the processing tools it will be understood that this invention is concerned with sheet glass processing machines, the processing tools of which are arranged above the glass sheet.

In order to follow the profile pattern of the edge, feeler units or assemblies are used which sense the profile pattern of the edge and pilot the tool holder to direct and position it in a desired way.

Such feeler units include one or more edge-following rollers which engage with the sheet edge, or even with a template placed underneath the glass sheet, to follow the profile thereof.

Further, a back-up roller is usually employed which supports the glass sheet from underneath to oppose any flexing of the sheet under its own weight.

With prior feeler units, it is recognized that, as the feeler unit is positioned relatively to the sheet edge and especially where no template is used, the back-up roller tends to strike the glass sheet with some force, which may result in local damage to the sheet, thus producing a defect therein which, albeit of minor import, still is quite noticeable.

In an effort to remove that drawback, it has been common practice to provide in some cases for a slight bevelling of the edge bottom end to prevent any damage from impact as stated above, but this procedure, additionally to affecting the quality of the product, involves an additional processing step that reflects unfavourably on the overall cost of the finished product.

SUMMARY OF THE INVENTION

It is, accordingly, a primary object of this invention to obviate such prior shortcomings by providing a feeler unit for sheet glass edges processing which is effective to prevent the back-up roller from striking the sheet edge even when the latter is processed without a template, thereby any likelihood of faulty processing is eliminated without providing additional processing steps.

Another object of the invention is to provide a feeler unit which lends itself particularly to application disclosed in U.S. Pat. No. 4,478,007 on a machine of the Applicant, which machine has the unique feature of enabling, without any special alteration thereof, processing of a glass sheet edge either with or without a back-up template, as hereinafter described.

It is a further object of this invention to provide a feeler unit wherein a sheet edge can be supported true during all of the processing steps also at the corner regions between adjoining sides where, conventionally, the roller would preliminarly move away from the sheet, thus leading to possible imperfections at the merging area of the bevels along two adjoining sides.

Still another object of this invention is to provide a feeler unit for positioning processing tools employed in processing edges of sheet glass and the like, which is simple construction-wise and can give full assurance of being reliable and safe to use.

These and other objects, such as will be apparent hereinafter, are achieved by a feeler unit for positioning sheet glass processing tools, according to the invention, which comprises a frame carrying at least one feeler roller piloting the tool holder positioning motor, and a back-up roller engageable with the underside of the edge region of a glass sheet being processed and rotatable about an axis substantially parallel to the plane containing said glass sheet and substantially perpendicular to the sheet edge being processed, and is characterized in that it comprises means for controllably imparting at least one movement to said back-up roller at least in a direction transverse to said glass sheet.

BRIEF DESCRIPTION OF THE DRAWINGS

Further features and advantages of the invention will be more readily understood from the following detailed description of a preferred, but not exclusive, embodiment of a feeler unit for positioning a tool used in processing sheet glass or the like, with reference to the accompanying illustrative, and not limitative, drawing, where.

DESCRIPTION OF THE PREFERRED EMBODIMENTS

Figure 2:
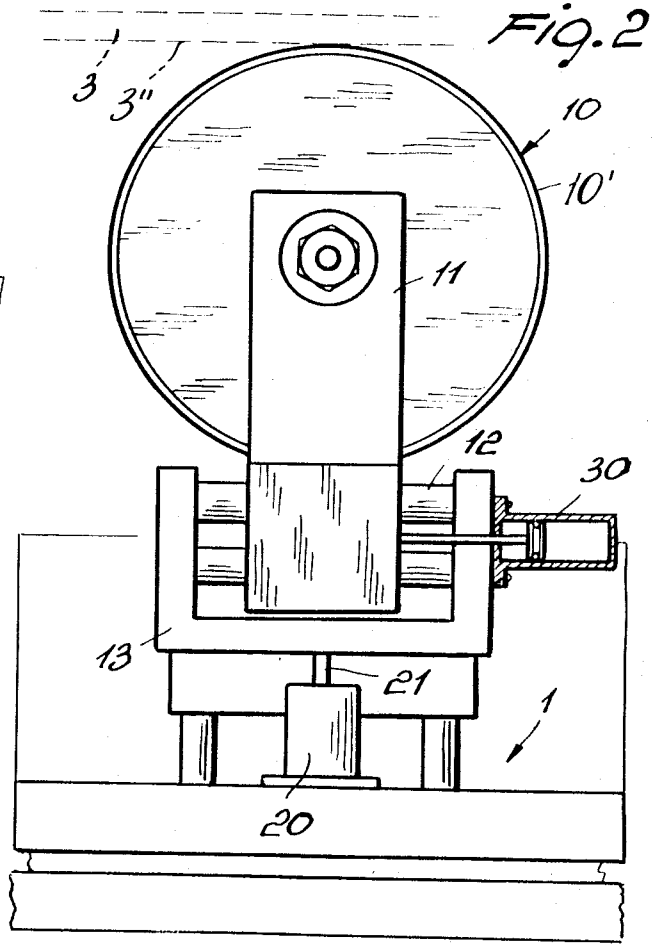
FIG. 2 shows a detail of the back-up roller as viewed frontally.

Making reference to the drawing views, the feeler unit for positioning tools used in processing sheet glass edges and the like comprises, according to this invention, a bearing frame, generally indicated at 1, whereon a pair of feeler rollers 2 are provided which are intended to follow the edge profile 3' of a glass sheet 3.

The feeler rollers 2 are carried rotatably on a block 4, which is operatively connected to a potentiometer or similar member adapted to pilot the tool holder positioning motor, not shown in the drawing because not a part of this invention and disclosed in U.S. Pat. No. 4,478,007.

Connected to said frame 1 is a back-up roller 10 having its circular periphery 10' engageable with the underside 3'' of the glass sheet 3, or optionally of a template if any is used, said roller 10 being rotatable about an axis 10'' which extends substantially parallel to the plane containing the sheet 3 and substantially perpendicular to the sheet edge being processed, the roller 10 being in tangential relationship with the underside 3'' of the sheet glass 3, when the roller is in its uppermost position as will be described later, the underside 3'' defining the plane of lay of the sheet glass 3.

The roller 10 is supported by a bracket 11 which can be moved along a pair of bars 12 lying parallel to the plane containing the sheet 3 perpendicular to the axis 10'' of the back-up roller 10 and extending substantially parallel to the true tangent of the glass sheet edge being processed. The bars 12 are carried at their ends in a movable bracket 13 which is slidably associated with a guide rod 15 extending perpendicularly to the plane containing the sheet 3 so as to permit the roller 10 to be moved towards and away from the sheet 3 in a direction transverse to said sheet 3.

Resilient means in the form of a bias spring 16 are also provided which act between an abutment provided on the movable bracket 13 and a widening 18 formed on the rod.

The movable bracket 13 is moved in the direction transverse to said sheet 3 by a small pneumatic piston 20 connected to the stationary frame 1 and having its rod 21 engaged with the movable bracket 13. Thereby the roller 10 is movably supported on the frame. It will be understood that the bracket 13, the rod 15 with the biasing spring 16 and the piston 20 and piston rod 21 constitute a guiding component member structure extending transverse to the plane of lay of the sheet glass.

The translatory movement of the bracket 11 along the bars 12 is accomplished through a second small piston 30 which allows the positional relationship between the back-up roller and feeler rollers 2 to be varied. It will be understood that the bars 12 and the piston 30 constitute a guiding component member structure extending in a direction parallel to the plane of lay of the sheet glass.

This enables the back-up roller to be engaged underneath the sheet before the sheet is engaged by the feeler rollers 2, and hence prior to processing; moreover, since the roller 10 is movable along the bars 12, it becomes possible upon exiting, i.e. on completion of a given edge processing, to move the roller 10 to the plane of lay of the sheet glass 3 and to the rear with respect to the forward direction of advance of the sheet 3, thereby the glass sheet receives support also at the last processing segment. This facility is not afforded by conventional machines, wherein as the relative positions between the back-up roller and feeler rollers are fixed, the glass sheet is left unsupported at the last segment by the back-up roller as the feeler rollers move past the sheet end in the direction of advance thereof, so that the glass sheet may flex and faulty processing occur mainly at the corner regions of the sheet. Furthermore, by providing the first piston 20, the roller 10 can be translated along a perpendicular direction to the glass sheet plane of lay, which allows that roller to be lowered as the initial contact is established between the sheet and feeler unit, thereby the sheet corner edge will not strike the back-up roller; later, by actuation of the piston 20, the back-up roller would be raised to a desired level to thus hold the sheet truly flat.

Figure 1:
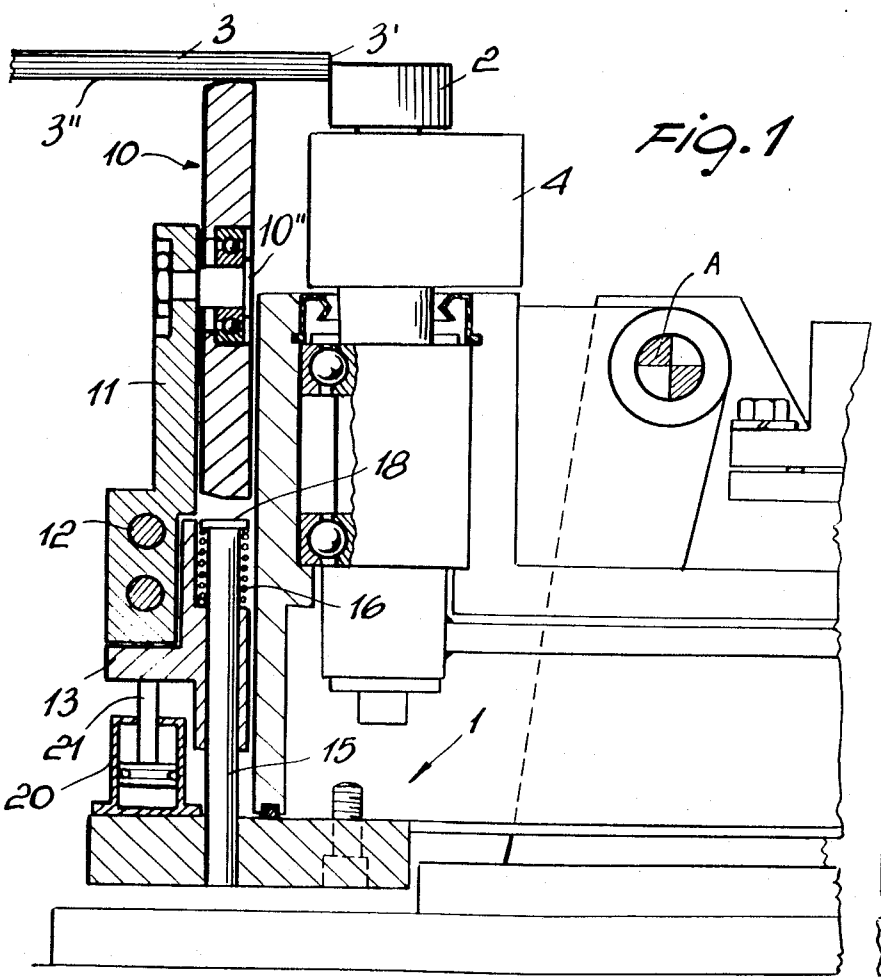
FIG. 1 shows the feeler unit of this invention with the back-up roller in section along a vertical axial plane.

In fact, the glass sheet 3 is moved into the position shown in FIG. 1 by a translatory movement from left to right as viewed in the drawing. Since the free leading portion is slightly deflected by its own weight, impact against the roller 10 would occur if the latter were not lowered initially.

The applicant's machines on which the above described device is advantageously applicable has the frame 1 angularly adjustable about an axis of rotation A extending parallel to the direction tangential to the edge to be processed of the sheet 3 and at a distance therefrom so that the feeler rollers 2 may be slightly raised or lowered by such angular adjustment of the frame 1 depending on the absence or presence of a template (not shown) below the sheet 3.

Thus, it may be appreciated from the foregoing description that the invention achieves its objects, and in particular the fact should be enhanced that the provision of a back-up roller for the sheet edge which is translatable to and from the plane containing said sheet as well as in a parallel direction to the edge major dimension—i.e. perpendicularly to the axis of the feeler roller—affords at all times an accurate support for the glass sheet also at the initial processing regions and end regions, which was not made possible heretofore because support was only provided either at the initial stage or final, with attendant processing imperfections and deterioration of the resulting product quality.

The invention as disclosed is susceptible to many modifications and variations without departing from the true scope of the instant inventive concept.

Furthermore, all of the details may be replaced with other, technically equivalent, elements.

In practicing the invention, the materials used, as well as the dimensions and contingent shapes, may be any suitable ones to meet individual applicational requirements.

I claim:

1. A back-up roller mechanism for sheet glass in combination with a feeler unit for positioning sheet glass processing tools, the combination comprising a common frame for supporting the back-up roller mechanism and for carrying at least one feeler unit having a feeler roller, the back-up roller mechanism comprising a movable back-up roller near said feeler roller and defining a plane of lay of the back-up roller, support means for rotatably supporting said back-up roller and defining an axis of rotation for said back-up roller extending transverse to said plane of lay thereof, said back-up roller having a circular perphery, said periphery defining a plane of lay of sheet glass tangential to said periphery when said roller is in its operative position and transverse to the plane of lay of said back-up roller and, on said common frame, guide means for said support means for controllably moving said back-up roller at least in one direction perpendicular to said axis of rotation thereof thereby to controllably move said back-up roller in a retracted position away from said plane of lay of said sheet glass when said sheet glass is being moved in its processing position towards said feeler roller and to controllably move said back-up roller in an operative position towards said plane of lay of said sheet glass when said sheet glass has reached said processing position thereof in engagement with said feeler roller and wherein said support means and said guide means are composite support and guide means having a first guiding component member structure comprising first bracket means, guiding rod means extending transverse to said plane of lay of said sheet glass and in slidable guiding engagement with said first bracket means allowing slidable movement of said first bracket means along said guiding rod means, pressure fluid operated cylinder and piston means on said common frame and connected with said first bracket means for moving alternativelly bothways said first bracket means along said guiding rod means from an operative position of said back-up roller to a retracted position thereof and vice-versa, second bracket means carrying said back-up roller, guiding bar means carried by said first bracket means, said guiding bar means extending parallel to said plane of lay of said sheet glass at a distance therefrom and perpendicular to said axis of rotation of said back-up roller, said guiding bar means being in slidable guiding engagement with said second bracket means and second pressure fluid operated cylinder and piston means carried by said first bracket means and connected with said second bracket means for controllably moving alternativelly bothways said second bracket means along said guiding bar means.

2. A mechanism according to claim 1, wherein said guiding rod means include spring means biasing the movement of said first bracket means in at least one direction of movement along said guiding rod means.

3. A mechanism according to claim 1, wherein said common frame has pivot means allowing angular adjustment of said common frame about an axis parallel to said plane of lay of the sheet glass.

* * * * *